United States Patent [19]

Matsuo

[11] 4,192,460

[45] Mar. 11, 1980

[54] REFRACTORY POWDER FLAME PROJECTING APPARATUS

[75] Inventor: Masataka Matsuo, Nakama, Japan

[73] Assignee: Nippon Steel Corporation, Tokyo, Japan

[21] Appl. No.: 959,771

[22] Filed: Nov. 13, 1978

[30] Foreign Application Priority Data

Nov. 15, 1977 [JP] Japan ..... 52-152317

[51] Int. Cl.[2] ..... B05B 1/24

[52] U.S. Cl. ..... 239/79; 239/85; 239/419.3; 239/553.5; 264/30

[58] Field of Search ..... 239/79, 85, 419.3, 422, 239/553, 553.5; 264/30

[56] References Cited

U.S. PATENT DOCUMENTS

| | | | |
|---|---|---|---|
| 2,418,533 | 4/1947 | Walker | 239/422 |
| 2,746,883 | 5/1956 | Powers | 239/85 |
| 3,085,865 | 4/1963 | Long et al. | 239/419.3 |
| 3,333,774 | 8/1967 | Demaison | 239/85 |
| 3,565,345 | 2/1971 | Moltzan | 239/422 |
| 3,841,565 | 10/1974 | Buisson et al. | 239/553 |
| 4,136,828 | 1/1979 | Anderson et al. | 239/422 |

*Primary Examiner*—Robert B. Reeves
*Assistant Examiner*—Michael J. Forman
*Attorney, Agent, or Firm*—Wenderoth, Lind & Ponack

[57] ABSTRACT

A refractory powder flame projecting burner apparatus for lining repair or refractory fabrication in which oxygen-gas-entrained refractory powder is forcibly supplied to a burner where the oxygen gas mixes with fuel gas. A plurality of flame nozzles are provided in at least two parallel rows. A plurality of powder projecting nozzles are provided between and parallel to the rows of flame ports. A powder path is provided within the burner along the row of the powder projecting nozzles. A distributor having a plurality of axial grooves, with partitioned cavities at one end thereof, is inserted in the burner so that each cavity communicates with a plurality of the powder projecting nozzles. This refractory powder flame projecting apparatus forms a dense and durable refractory layer with a high yield.

4 Claims, 14 Drawing Figures

REFRACTORY POWDER FLAME PROJECTING APPARATUS

BACKGROUND OF THE INVENTION

This invention relates to a refractory powder flame projecting apparatus, and more particularly to an apparatus for projecting fused or semi-fused refractory powder to deposit refractory buildup for the purpose of repairing the worn or eroded portion of furnace refractory lining, manufacturing refractory brick, or building furnaces.

Furnaces and their auxiliary facilities used in the steel industry are mostly lined with refractory brick. With the passage of time, however, the refractory brick lining progressively wears or erodes down, either chemically attacked by high-temperature gases or slag or due to mechanical abrasion. When a certain time has passed, therefore, they are relined either totally or only in the damaged portions.

Conventionally, the repair is commonly accomplished by a technique known as the wet method, which comprises spraying powder material mixed with water. But this method has the following drawbacks:

(1) Refractory powder mixed with a small quantity of water does not adhere strongly to the sprayed areas, resulting in a great refractory loss.

(2) On spraying such a wet refractory mass onto furnace walls at high temperature, the water contained in the mixture evaporates quickly causing the refractory to form a porous, low-strength layer. When a binder or a flux is added to the mixture, the sprayed layer often becomes detached before attaining adequate sintered strength due to decomposition.

(3) Spraying the wet refractory mass onto hot furnace walls causes a sharp temperature drop, which in turn gives rise to spalling.

For these reasons, the wet-type relining technique is unable to form a refractory layer with good adhesiveness and high durability.

To eliminate the aforementioned shortcomings in the wet-type relining technique, several techniques to project refractory powder by flame have been proposed recently. The basic principle of these techniques is similar to that of a conventional practice popularly employed for applying ceramic coating on a metal surface and so on. But these flame projecting techniques can hardly be used for furnace relining and other similar purposes because of difficulties concerning the projecting capacities, workers safety, and properties of the formed refractory layer. Some techniques (such as one described in "Schweissen von Kokskammern und Glashafen mit Keramik Pulvern," Silikatechnik 21 (1970), No. 1, pp. 18–20) have been developed to overcome such difficulties which are also sought to be overcome by this invention. But none of them can form a dense, durable refractory layer. Besides the structure of the equipment they use is unsuitable for the relining of furnaces from the standpoint of projecting efficiency and safety.

SUMMARY OF THE INVENTION

The general object of this invention is to overcome the aforementioned shortcomings in the conventional refractory powder flame projecting burner. More specifically, an object of this invention is to provide a refractory powder flame projecting apparatus that forms a dense, durable refractory layer.

Another object of this invention is to provide a high-yield refractory powder flame projecting apparatus.

Still another object of this invention is to provide a safe refractory powder flame projecting apparatus free of explosion due to backfiring.

To achieve the aforementioned objects, a refractory powder flame projecting apparatus of this invention forcibly supplies oxygen-gas-entrained refractory powder to its burner where the oxygen gas mixes with fuel gas. A plurality of flame nozzles are provided in at least two parallel rows. A plurality of powder projecting nozzles are provided between and parallel to the rows of flame nozzles. A powder path is provided within the burner along the row of the powder projecting nozzles. A distributor having a plurality of axial grooves, with partitioned cavities at one end thereof, is inserted in the burner so that each cavity communicates with a plurality of the powder projecting nozzles.

BRIEF DESCRIPTION OF THE DRAWINGS

FIG. 1A shows an arrangement wherein flame nozzles are disposed both inside and outside powder projecting nozzles, while FIG. 1B shows an arrangement with the flame nozzles opening only outside the material projecting nozzles.

FIG. 2A shows an arrangement wherein flame nozzles are disposed above and below powder projecting nozzles, FIG. 2B is similar to FIG. 2A, but the flame and powder projecting nozzles are off set, and FIG. 2C shows an arrangement wherein three rows of flame nozzles are interposed between two rows of powder projecting nozzles.

FIG. 5A shows the effect achieved by a conventional projecting burner and FIG. 5B by one according to this invention.

DETAILED DESCRIPTION OF THE INVENTION

Now a detailed description of this invention will be given with reference to the accompanying drawings.

A feature of this invention lies in a refractory powder flame projecting burner for furnaces that assures good and quick fusion of refractory powder materials and formation of a smooth refractory layer.

Figure 1A:
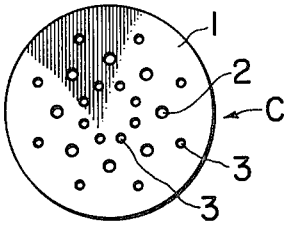
FIG. 1A PRIOR ART
FIGS. 1A and 1B are front views of conventional refractory powder flame projecting burners.
Figure 1B:
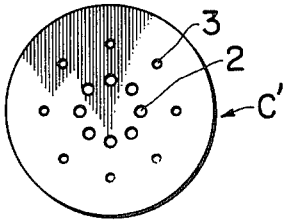
FIG. 1B PRIOR ART
Figure 2C:
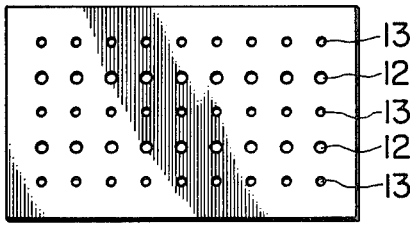

FIGS. 1A and 1B are front views of conventional refractory powder flame projecting burners (hereinafter referred to as the C-type and C'-type projecting burner, respectively). The C-type projecting burner comprises a cylindrical burner tip 1, with one end thereof being provided with a number of circularly disposed powder projecting nozzles 2. A ring of the powder projecting nozzles 2 lies between a larger and a smaller ring each comprising a number of circularly disposed flame nozzles 3. In the C'-type burner shown in FIG. 1B, the flame nozzles 3 are provided only outside the ring of the powder projecting nozzles 3.

Figure 2A:
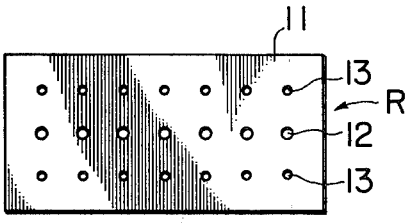
FIGS. 2A, 2B and 2C are front views of refractory powder flame projecting burners according to this invention.
Figure 2B:
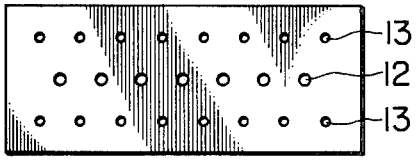

By contrast, a refractory powder projecting burner according to this invention (hereinafter referred to as the R-type burner) comprises a substantially parallelipiped burner 11, as shown in FIG. 2A. On one side thereof are provided a line of longitudinally disposed powder projecting nozzles 12, which lies between two parallel lines of numerous flame nozzles 13. The powder projecting nozzles 12 project refractory powder (consisting essentially of, for example, $SiO_2$ and $Al_2O_3$) entrained by oxygen, while the flame nozzles 13 project flames produced by burning such fuel as propane. The material projecting nozzles 12 and the flame nozzles 13 each have a diameter of, for example, between approximately 2 and 3 mm, and are individually spaced at intervals of 2 to 4 mm. The line of the powder projecting nozzles 12 is spaced from the lines of the flame nozzles 13 by 3 to 8 mm. Each line comprises 20 to 40 powder projecting nozzles 12 or flame nozzles 13. In FIG. 2A, the material projecting nozzles 12 and the flame nozzles 13 lie on the same vertical lines, but they may be off set as shown in FIG. 2B, too. It is also possible to increase the number of both nozzles by, for example, providing three lines of flame nozzles 13 between two lines of powder projecting nozzles 12.

The performance of the above-described three burners C, C' and R will be compared below. Against the test wall surface was projected a refractory powder material (consisting essentially of $SiO_2$, having a fusing point of 1300° C., and pulverized to under 0.2 mm), with 15 $m^3$/hr of LPG and 75 $m^3$/hr of oxygen. Then, their projecting capacities and yields and the density of the projected layers were measured.

Figure 3:
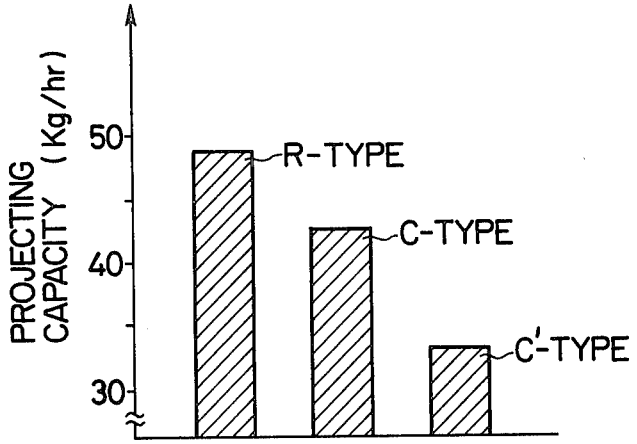
FIG. 3 is a histogram comparing the projecting capacities of conventional refractory powder flame projecting burners and one according to this invention.

FIG. 3 shows the projecting capacities of the individual burners, each supplied with 50 kg/hr of the refractory powder materials. The R-type projected 45 kg/hr of refractory powder onto the test wall surface, the C-type 42.5 kg/hr. and the C'-type 33 kg/hr. As seen, the projecting capacity descends in the order of R, C and C' (R>C>C').

Figure 4:
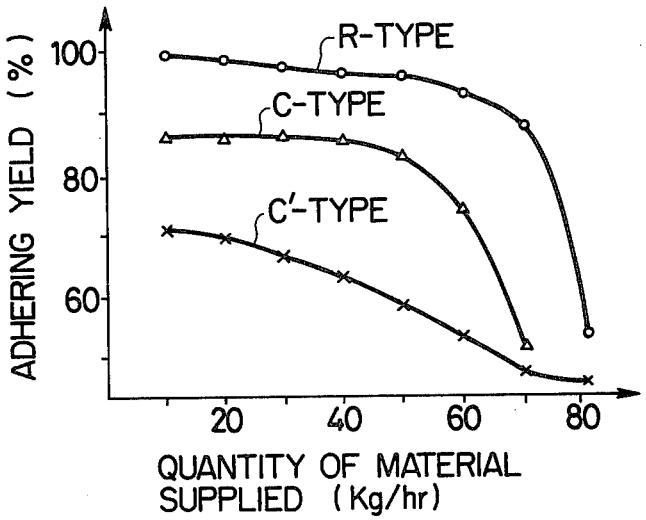
FIG. 4 is a graph comparing the adhering yields of projected refractory among the same burners.

FIG. 4 graphically shows the relationships between the quantity of the refractory powder materials projected and its adhered yield. The yield commonly drops with increasing projected quantity. But, here again, the yield decreases in the same order as above. This test evidenced the superiority in projecting capacity and yield of this invention over the conventional burners.

Next, the density of the refractory layers formed on the test wall surface by the burners R, C and C' was investigated. Table 1 shows the apparent porosity and compressive strength of the refractory layers formed by the individual burners.

Table 1

| Burner Type | R | C | C' |
|---|---|---|---|
| Apparent Porosity (%) | 5–10 | 8–13 | 13–15 |
| Compressive Strength (kg/cm$^2$) | 600–800 | 400–600 | 300–400 |

As evident from Table 1, the apparent porosity decreases in the order of C', C and R (C'>C>R), which indicates that the refractory layer formed by the R-type is most dense. The compressive strength increases with the density of the refractory layer. Therefore, it decreases in the order of R, C and C' (R<C<C').

The aforementioned difference in performance among the types R, C and C' is due to the difference in (1) the fusibility of the refractory powder in the burner, and (2) the time required for fusing. The refractory powder fuses well and uniformly when it is distributed uniformly in the flame. The R-type burner according to this invention satisfies this requirement. In the conventional C-type burner, the outside flame nozzles provide more heat to the refractory powder projected from the powder projecting nozzles than the inside flame nozzles, thus impeding the attainment of uniform refractory powder distribution and fusing. In this respect, the R-type is designed more advantageously than the C-type.

The burner of this kind has to fuse the refractory powder in a short time with a limited amount of flame energy. In other words, the refractory powder has to be heated to high temperatures as quickly as possible. For this purpose, the burner must produce such flames that their hottest portion develops near the burner proper. The R-type apparatus of this invention produces streamlined, turbulence-free flames, with the hottest portion lying at a short distance from the burner, thereby achieving the desired quick material fusing. This quick fusibility is especially useful for operations in a limited space, such as one in a coke-oven chamber where the furnace walls are spaced from each other at intervals of only 400 mm or thereabouts.

Figure 5B:
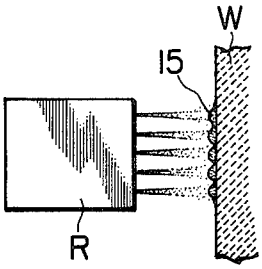
FIGS. 5A and 5B are side elevation views of furnace walls with refractory powder projected by flame thereon.
Figure 5A:
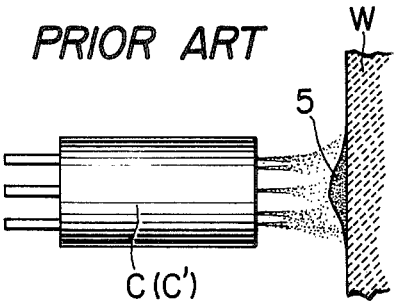
FIG. 5A PRIOR ART

The shape of the refractory layer formed often exercises an important effect on subsequent operations. For instance, an overly large projection on the repaired wall of a coke-oven chamber impedes the coke-pushing operation. As shown in FIG. 5A, the conventional C- and C'-type form a substantially conical refractory deposit 5 on the furnace wall W. As opposed to them, the R-type apparatus of this invention forms a refractory layer 15 that consists of numerous ridges extending over the furnace wall W. The ridges are low, so that they, as a whole, constitute a flat surface which does not impede the coke-pushing operation.

To increase the projecting capacity, the numbers of the powder projecting and flame nozzles should be increased. In the conventional C- and C'-type, however, this necessitates increasing the diameter of the burner proper, which is detrimental to the attainment of good and quick fusion of refractory powder and formation of a smooth refractory layer. With the R-type burner of this invention, the increase can be accomplished by increasing the width and/or height of the burner proper, without damaging the desired burner functions.

Now, details of the R-type refractory powder projecting burner will be described.

Figure 6:
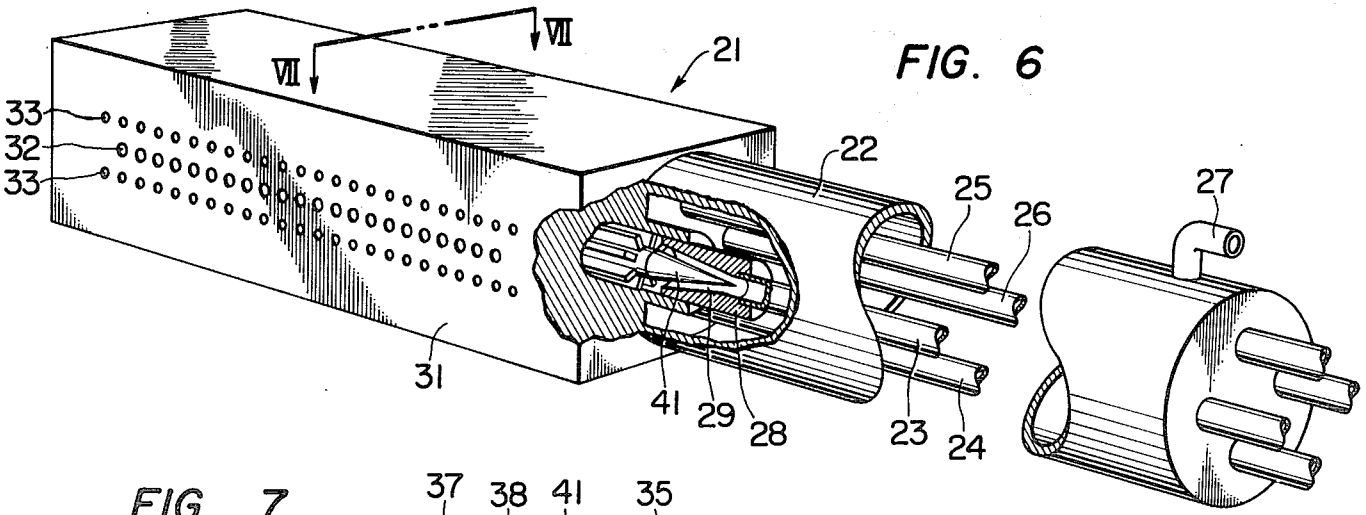
FIG. 6 is a perspective view, with a part thereof cut open, showing a refractory powder flame projecting burner embodying the principle of this invention.

FIG. 6 shows an embodiment of the R-type refractory powder projecting burner according to this invention. A projecting burner 21 comprises a barrel 22 and a parallelpiped burner body 31 that is fixed to one end thereof. The barrel 22 contains a material supply pipe 23 to supply a refractory powder material with oxygen to material projecting nozzles 32 described later, an oxygen supply pipe 24 and a fuel supply pipe 25 that respectively supply oxygen and propane to develop flames. The barrel 22 also contains a cooling water pipe 26 for cooling the burner body 31, with a cooling water exhaust pipe 27 attached to the cylindrical surface of the barrel 22.

Figure 7:
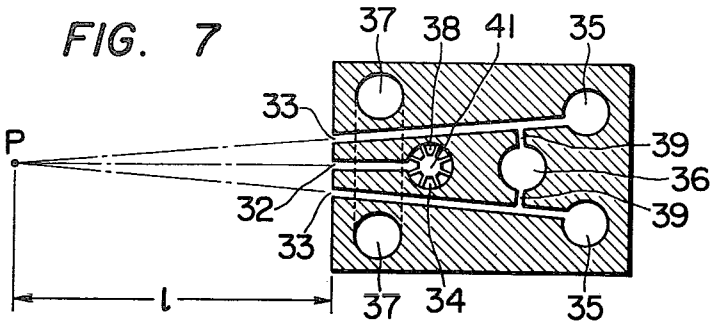
FIG. 7 is a cross-sectional view taken along the line VII—VII of FIG. 6.
Figure 8:
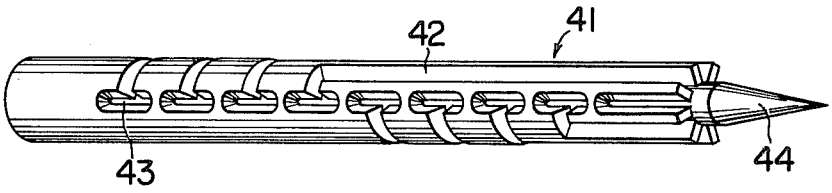
FIG. 8 is a perspective view of a powder distributor used in the refractory powder flame projecting burners of FIG. 6.

A line of longitudinally disposed powder projecting nozzles 32 is provided in the front side of the burner body 31, interposed between two lines of similarly disposed flame nozzles 33. As shown in FIG. 7, a powder passage 34, oxygen passages 35, a fuel passage 36 and a cooling water passage 37 are longitudinally provided through the burner proper 31. The powder passage 34, oxygen passage 35, fuel path 36 and cooling water path 37 communicate with said material supply pipe 23, oxygen supply pipe 24, fuel supply pipe 25 and cooling water pipe 26, respectively.

A rod-like distributor 41 is inserted in said powder passage 34. The distributor 41 is fabricated with a plurality of axial grooves 42 (e.g., the embodiment being described has eight grooves). The longest one of the grooves 42 extends close to the remotest end of the distributor 41, with the others shortening gradually. The remotest ends of the grooves 42 respectively communicate with a plurality of cavities 43 (e.g., the embodiment being described has eight cavities) which are disposed in an axial line and separated from each other. The entry ends of the grooves 42 open in the entry-side end, having a conical portion 44, of the distributor 41. When the distributor 41 is inserted, the powder passage 34 is divided into eight small passages 38, as shown in FIG. 7. Then each cavity 43 communicates with two or three material projecting nozzles 32. Together with a sleeve 28, which has a conically expanding passage which is and fixed in the barrel 22, the conical portion 44 forms a passage 29 for smoothly introducing the refractory powder, supplied from the powder supply pipe 23, to the inlets of said small passages 38, as shown in FIG. 6. Through the small passages 38, the above-described distributor 41 uniformly supplies the refractory powder from the powder supply pipe 23 to all powder projecting nozzles 32, whether they are located close to the barrel 22 or the remotest end of the burner body 31.

As shown in FIG. 7, the upper and lower oxygen passages 35 are provided close to the rear side of the burner body 31, and communicate with the upper and lower flame nozzles 33, respectively. The upper and lower flame nozzles 33 are slightly inclined so that their axes meet at point p spaced distance l from the front side of the burner body 31. Point p lies on the axis of the powder projecting nozzle 32. A suitable range for distance l is between 150 mm and 3000 mm. If distance l is shorter than 150 mm, the refractory powder does not fuse sufficiently. Conversely, if distance l exceeds 3000 mm, the fused powder does not focus but diffuses.

As shown in FIG. 7, the fuel passage 36 is located behind the powder passage 34 and communicates with the upper and lower flame nozzles 33 through passages 39. As will be understood, the burner proper of this invention is of the so-called inside-mixing type. Namely, fuel and oxygen gases mix inside the burner. Compared with flames formed by the outside-mixing type, those by the inside-mixing type are stable and focus well. Therefore, the inside-mixing type burner is suited for fusing and projecting a large quantity of refractory powder in a short time.

To insure accurate, effective repairing, the projecting burner must be capable of advancing close to a damaged portion of the furnace wall heated to a high temperature and of repeating vertical, horizontal and rotational motions with respect to that portion. To attain this object, the barrel 22 is fixed to the burner body 31, as shown in FIG. 6. Because the projecting burner enters a high-temperature zone, the burner body 31, barrel 22 and pipes 23, 24, 25 and so on contained in the barrel 22 must be cooled. The burner body 31 is heated more intensely than the barrel 22, and the intensity of heating decreases in proportion to the distance from the furnace. Therefore, the burner body 31 should be cooled most intensely, but the other less hot portions require only minor cooling. As seen in FIGS. 6 and 7, cooling water from the cooling water supply pipe 26 first enters the upper cooling water passage 37 in the upper front portion of the burner body 31, then passes into the lower cooling water passage 37 at a point near the remotest end of the burner body 31. After cooling the burner body 31, the water flows into the barrel 22 to cool the pipes 23, 24, 25 and so on, then flows outside through the exhaust pipe 27. This system permits cooling the hottest burner body 31 with cold water, having a high cooling effect, by the cooling water supply pipe 26.

Another feature of this invention lies in a refractory powder projecting burner that forms a good refractory layer and assures a safe projecting operation.

As mentioned previously, this invention uses the inside-mixing system. Because of its susceptibility to backfiring, use of this system has conventionally been confined to projecting burners and welding torches which require small quantities of fuel. In the projecting burner of this invention which consumes a large quantity of fuel gas, backfiring may give rise to a dangerous explosion. To avoid this hazard, large-capacity projecting burners have generally employed the outside-mixing system. But this type of technique can not furnish adequate heat to the refractory powder, and therefore fails to produce a dense, durable refractory layer.

A common practice to insure safe combustion of fuel gas is to stop the supply of oxygen first, then the supply of fuel gas. For this reason, oxygen and fuel gas are mixed at a position a considerable distance upstream from the flame nozzle. In such a design, the stopping of oxygen flow brings about a decrease in the flow rate of the mixed gas in the vicinity of the flame nozzles, whereupon flames travel back to the upstream position where oxygen and fuel gas are mixed. This is a phenomenon known as backfiring.

The inventor made various studies and experiments to find an effective method of preventing such backfiring. Consequently, it was found effective to prevent such a flow rate drop in the vicinity of the flame nozzles by feeding air or an inert gas into the burner as the supply of oxygen is stopped. This method permits employing the inside mixing system and ensures a safe, efficient projecting operation.

The projecting burner must fuse a large quantity of refractory powder in a short time and provide an efficient, localized projection to a target area. In addition, it is required to remove carbon and tar from the furnace wall and provide preheating to the cleaned furnace wall before proceeding to refractory projection. The walls of a coke oven, in which pulverized coal is dry-distilled, are covered with considerable quantities of carbon and tar. Although they stick fast, the carbon and tar themselves do not have high strength, so that forming a refractory layer thereon results in peeling off of the thus formed refractory layer. Therefore, the pre-removal of the adhered carbon and tar is essential. To facilitate the adhesion of the projected refractory mass, the furnace wall should be kept above a certain temperature. The inventor's experiments disclosed that good adhesion is not obtained unless the wall temperature is higher than 400° C.

As discussed above, a satisfactory refractory layer does not form unless the furnace wall is cleared of carbon and tar and provided with adequate preheating before the start of projection. Accordingly, the projecting burner of this invention controls oxygen for combustion and oxygen for material transportation separately. In addition to the aforementioned reason, provision of such independent controls is also due to the need to control fuel gas with changes in the type and quantity of refractory powder supplied.

Now the refractory powder flame projecting burner containing devices for supplying refractory powder, oxygen and fuel gas and controlling their flows in order to perform the aforementioned function will be described.

Figure 9:
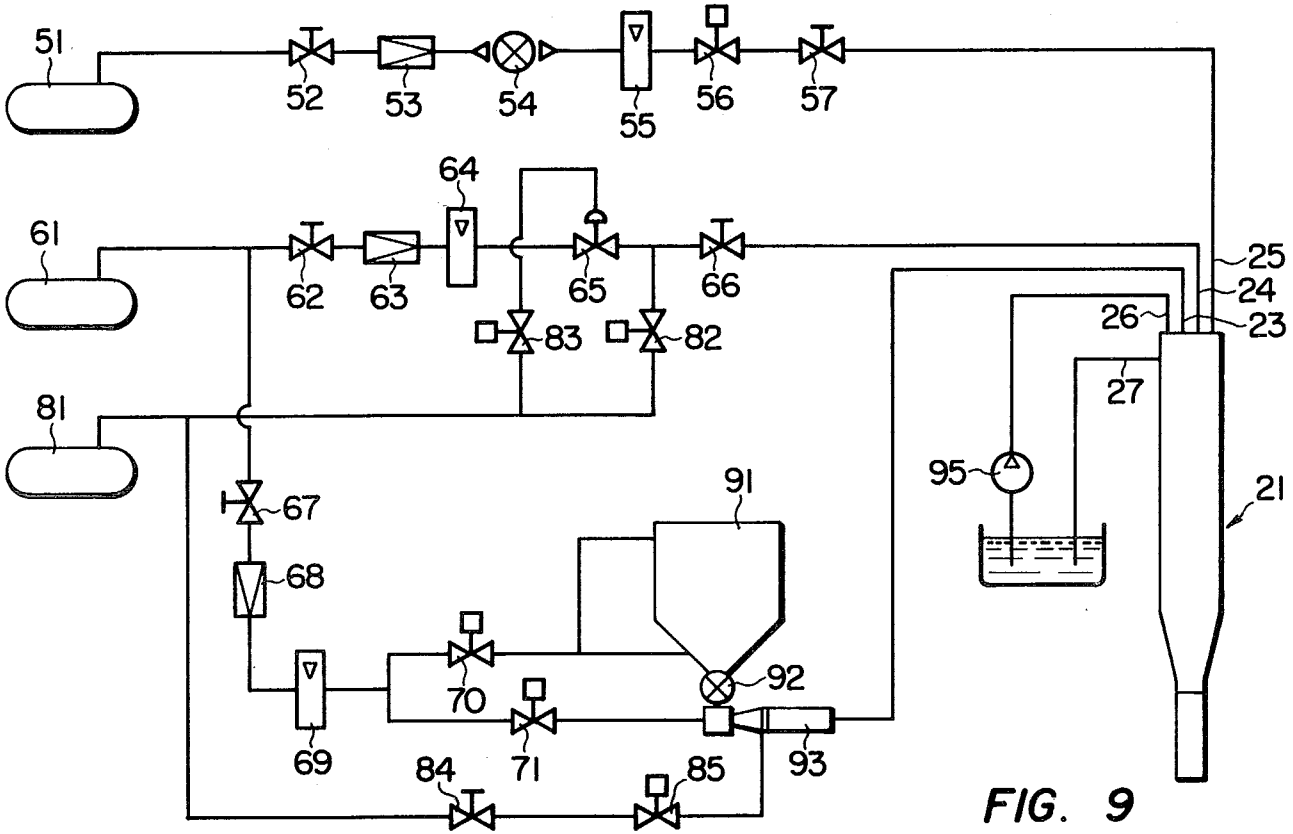
FIG. 9 is a diagram of the piping for supplying material refractory powder, oxygen and fuel gases, and air to the projecting burner of FIG. 6 and controlling their flows.

As shown in FIG. 9, fuel gas flows from a fuel gas reservoir 51 through a stop valve 52 and a reducing valve 53, where the pressure of the fuel gas is reduced to a given level, to a safety device 54. Leaving the safety device 54, the fuel gas passes through a flow meter 55, a solenoid valve 56 and a flow-rate regulating valve 57, where the flow rate is controlled to a given level, to the projecting burner 21.

Likewise, oxygen for combustion flows from an oxygen reservoir 61 through a stop valve 62, a reducing valve 63, a flow meter 64, an air-operated valve 65 and a flow-rate regulating valve 66 to the projecting burner 21. Oxygen for material transportation flows from said oxygen reservoir 61 through a stop valve 67 and a reducing valve 68 to a flow meter 69 where it is divided into two streams. One stream flows through a solenoid valve 70 into a powder hopper 91, while the other stream flows through a solenoid valve 71 into an ejector 93.

Compressed air in an air reservoir 81 is used for combustion and gas-purging. The air from the air reservoir 81 is divided into two streams. One stream flows through a solenoid valve 82 to the entry side of said flow-rate regulating valve 66 in the combustion oxygen line. Part of this stream flows also through a solenoid valve 83 to the operating section of said air-operated valve 65. The other stream from the air reservoir 81 flows through a stop valve 84 and a solenoid valve 85 to said ejector 93.

Figure 10:
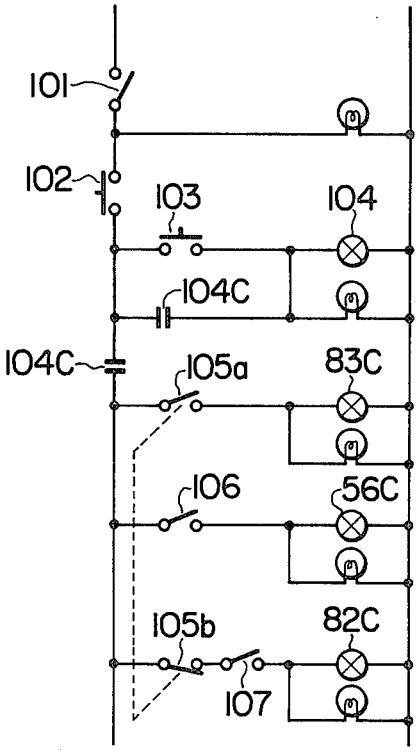
FIG. 10 is a circuit diagram for solenoid valves shown in FIG. 9.

The air-operated valve 65 and solenoid valve 82 are interlocked so that one opens when the other closes and vice versa. FIG. 10 shows a circuit to achieve the above-described flows. As seen, a power switch 101 and an emergency stop switch 102, arranged in that order, are followed by a starting switch 103. Closing the starting switch 103 energizes a relay coil 104, closes a contact **104*c* and actuates the projecting burner 21. An on-off switch 105*a* for the air solenoid valve 83, a switch 105*b* interlocked therewith, and an on-off switch 106 for the fuel-gas solenoid valve 56 connect, in parallel, with the emergency stop switch 102. Closing the switch 105*a* energizes a relay coil 83*c*, closes the solenoid valve 83, and opens the air-operated valve 65, whereupon the switch 105*b* opens and the solenoid valve 82 closes. Opening the switch 105*a* closes the switch 105*b*. Then, closing a switch 107, which is connected in series with the switch 105*b*, energizes a relay coil 82*c* and opens the solenoid valve 82. At the same time, the solenoid valve 83 also opens to supply air to the operating section of the air-operated valve 65 to close it. Closing the switch 106 energizes a relay coil 56*c* and opens the solenoid valve 56 to supply fuel gas to the projecting burner 21**.

The material hopper 91, perssurized by the oxygen from the oxygen reservoir 61, contains a refractory powder, which is supplied through a rotary valve 92 to the ejector 93. The oxygen gas from the solenoid valve 71 sucks the refractory powder from the powder hopper 91 into the ejector 93, then forcibly sends it to the projecting burner 21.

A pump 95 supplies cooling water to the projecting burner 21. After cooling the projecting burner 21, the used water leaves the projecting burner 21 through the exhaust pipe 27.

Now the following paragraphs describe the operation of the above-described projecting burner according to this invention.

To begin with, cooling water is supplied to cool the projecting burner 21 as described before. This cooling is continued until the projecting burner draws back from the high temperature furnace after the repairing operation is completed.

The solenoid valve 82 is opened to supply air to the projecting burner 21. Then, the solenoid valve 56 is opened to supply fuel gas to the projecting burner 21. The pressure and flow rate of the fuel gas are preset. The projecting burner 21 projects through the flame nozzles 13 flames developed by burning the fuel gas and air. Then, the solenoid valve 83 operates to open the air-operated valve 65, which supplies oxygen to the projecting burner 21 to develop normal flames with the fuel gas and oxygen. Being interlocked, the solenoid valve 82 closes as the air-operated valve 65 opens, thereby shutting off the supply of the air to the projecting burner 21.

With the burner thus ignited, the projecting burner gives a pretreatment to the furnace wall requiring repairs. As mentioned previously, effective refractory projection cannot be achieved unless the furnace wall is freed of carbon and tar and maintained above 400° C. For this purpose, the projecting burner of this invention is designed to perform wall cleaning and preheating, projecting only flames. Since the adhering carbon and tar consist substantially of carbonaceous substances, the flow-rate regulating valves 57 and 66 are adjusted so that the projecting apparatus 21 project oxygen-enriched oxidizing flames. The projected flames rapidly oxidize off the carbon and tar. When they are removed to a certain extent, the adhering layer itself becomes fragile and is blown off by the force of the projected flames, and a clean wall surface appears. This, the projecting burner 21 serves the dual function of oxidizing and blowing. To heat the cleaned wall above 400° C., preheating is provided after returning the flames to normal or neutral.

Refractory projection is started when the furnace wall to be repaired has been heated above 400° C. The solenoid valve 71 is opened to supply oxygen at high speed to the ejector 93, thereby developing a suction zone therein. The solenoid valve 70 is opened to pressurize the material hopper 91. Simultaneously, the rotary valve 92 is driven to uniformly supply the refractory powder to the ejector 93. The projecting burner 21 fuses the oxygen-entrained refractory powder, supplied from the ejector 93, with normal flames, and projects the fused refractory against the damaged wall. The quantity of material projected can be adjusted during operation by regulating the rotating speed of the rotary valve 92, the sucking force of the ejector 93, and the pressure inside the powder hopper 91. In such instances, the flow rates of the fuel gas and oxygen are adjusted accordingly by the flow-rate regulating valves 57 and 66, respectively.

On completion of the projecting operation, the flame-extinguishing operation starts. The solenoid valves 70 and 71 and the rotary valve 92 are closed to discontinue the supply of the refractory powder. Simultaneously, the solenoid valve 85 is opened to supply air, instead of oxygen, to the projecting burner to purge the refractory powder remaining between the rotary valve 92 and the projecting burner 21. This air-purging is continued while projection is discontinued. It is desirable that the solenoid valves 71 and 85 be interlocked so that one opens when the other closes and vice versa. After stopping the supply of the refractory powder, the air-operated valve 65 is closed. At the same time, the solenoid valve 82 opens to change the flame composition from oxygen and fuel gas to air and fuel gas. This change prevents the occurrence of back-fire. On stopping the supply of oxygen, the rate of gas supply to the projecting burner 21 drops, whereupon the flame travels back to the point where the oxygen and fuel gas are mixed. Therefore, air is supplied as the supply of oxygen is stopped, thus maintaining the gas projection rate from the projecting burner 21 high enough to prevent back-firing.

With the combustion oxygen line filled with air, the solenoid valve 56 is closed to complete the extinguishing operation. Consequently, the combustion oxygen and material transportation lines are filled with air when the flames are extinguished.

Passing an inert gas, such as nitrogen gas, through the fuel gas line is effective for pipeline purging. Especially when LPG is used, the purging gas should be limited to such inert gas as nitrogen. Air and other oxygen-containing gases form a combustible mixture that might cause backfiring, depending on oxygen content.

When all lines are thoroughly purged, the supply of air and cooling water is stopped to complete a cycle of the projecting operation.

Switches and other actuating means for the valves, flow meters and so on are collectively provided on a control panel, so that the operator can perform the projecting operation by manually operating such switches while watching the progress of the operation. The projecting burner may be automatically ignited and extinguished by connecting timers to the individual valves.

What is claimed is:

1. A refractory powder flame projecting apparatus comprising a projecting burner body, means for supplying fuel gas, means for supplying oxygen gas, means for supplying refractory powder, said refractory powder supplying means containing an ejector for projecting the oxygen gas from said oxygen supplying means into said projecting burner body, a barrel containing a fuel gas supply pipe, an oxygen gas supply pipe and a refractory powder supply pipe extending from the corresponding supplying means, and said burner body being fixed to one end of said barrel and having a refractory powder passage, and further having a fuel gas passage and an oxygen gas passage communicating with each other, said burner body having a plurality of flame nozzles and powder projecting nozzles opening out of one face of said burner body, said flame nozzles being disposed in at least two parallel straight lines, said powder projecting nozzles being disposed between and parallel to said lines of flame nozzles and a distributor having a plurality of axial grooves, said grooves having individually separated cavities at the remotest end thereof, said distributor being inserted in said refractory powder passage parallel to the lines of powder projecting nozzles so that each cavity communicates with a different plurality of the powder projecting nozzles.

2. A refractory powder flame projecting apparatus according to claim 1 wherein the flame nozzles on both sides of the powder projecting nozzle are inclined so that their axes meet at a point 150 mm to 3000 mm away from said face of the burner body.

3. A refractory powder flame projecting apparatus according to claim 1 wherein the flame nozzles and powder projecting nozzles of the burner body are provided in a rectangular plane.

4. A refractory powder flame projecting apparatus according to claim 1, further comprising a first stop valve between the oxygen gas supplying means and the oxygen gas supply pipe in said barrel, means for supplying compressed air or inert gas, a second stop valve between said supplying means and said oxygen gas supply pipe, and means for interlocking said two stop valves so that when one opens the other closes.

* * * * *